US005279916A

United States Patent [19]

Sumino

[11] Patent Number: 5,279,916

[45] Date of Patent: Jan. 18, 1994

[54] PROCESS FOR PRODUCING ELECTROPHOTOGRAPHIC PHOTOSENSITIVE MEMBER

[75] Inventor: Fumio Sumino, Yokohama, Japan

[73] Assignee: Canon Kabushiki Kaisha, Tokyo, Japan

[21] Appl. No.: 557,013

[22] Filed: Jul. 25, 1990

[30] Foreign Application Priority Data

Aug. 1, 1989 [JP] Japan ..... 1-197975

[51] Int. Cl.[5] ..... G03G 5/00

[52] U.S. Cl. ..... 430/134; 430/133; 427/8; 427/74; 427/133

[58] Field of Search ..... 430/133, 134; 427/8, 427/74, 435, 133

[56] References Cited

U.S. PATENT DOCUMENTS 4,448,798 5/1984 Kageyama et al. ..... 430/133

OTHER PUBLICATIONS

Patent Abstract of Japan, vol. 9, No. 33 (P-334) (1756), Feb. 13, 1985.

Patent Abstract of Japan, vol. 9, No. 58 (P-341) (1781), Mar. 14, 1985.

Patent Abstract of Japan, vol. 13, No. 467 (P-948) (3815), Oct. 23, 1989.

*Primary Examiner*—Marion E. McCamish

*Assistant Examiner*—S. Rosasco

*Attorney, Agent, or Firm*—Fitzpatrick, Cella, Harper & Scinto

[57] ABSTRACT

The present invention provides a process for producing an electrophotographic photosensitive member through application of a paint by dipping an object to be coated into a paint coating bath. The process comprises steps of: blowing a gas periodically into the paint from a lower portion of the paint coating bath agitate the paint, and dipping the object to be coated at a predetermined time after agitating the paint.

2 Claims, 1 Drawing Sheet

PROCESS FOR PRODUCING ELECTROPHOTOGRAPHIC PHOTOSENSITIVE MEMBER

BACKGROUND OF THE INVENTION

1. Field of the Invention

The present invention relates to a method for producing an electrophotographic photosensitive member, more particularly to a process for producing an electrophotographic photosensitive member employing dip coating.

2. Related Background Art

Dip coating has been widely practiced in coating processes for forming a photosensitive layer or an intermediate layer in production of electrophotographic photosensitive members. This method of dip coating comprises basically a means for bringing down an object to be surface-coated into a paint in a coating bath and subsequently pulling up the object at an appropriate speed.

Such a method of dip coating is suitable for production of electrophotographic photosensitive members having a seamless drum shape or the like in comparison with other coating methods in viewpoints of productivity, and the like. This method, however, frequently causes coating irregularity and coating defects depending on characteristics of the paint employed. In particular, defects such as coating irregularity, small lumps, and streaks are known to be liable to occur when a paint containing fine pigment particles is applied in a thin layer less than 10 $\mu$ thick. The main causes of defects include (i) turbulence of paint in a paint coating bath, (ii) sedimentation of pigment particles in a paint coating bath, (iii) coagulation of paint by thixotropy in a paint coating bath, and other causes. In the cases where a paint containing fine pigment particles having an anisotropic shape is used, particularly the third cause, namely thixotropy, exerts harmful influences. In an extreme case, a part of the paint undergoes gelation in the piping to make paint application impracticable, which is a serious problem in production of electrophotographic photosensitive members.

To solve such problems, the measures hitherto taken include (i) treatment of the paint itself such as addition of a dispersant, pretreatment of the pigment, selection of the optimum particle size of the paint, and so on, (ii) provision of an agitation apparatus in the paint coating bath or in the piping, and like methods.

However, the former measure (i) is not necessarily effective because there are many restrictions in consideration of the characteristics of electrophotographic photosensitive members, while the latter measure (ii) is also not effective because the agitator itself gives rise to turbulence of the paint. Use of ultrasonic wave was proposed, but it was impracticable because of generation of noise and heat.

SUMMARY OF THE INVENTION

The present invention intends to provide a process for producing an electrophotographic photosensitive member comprising a dip coating step capable of giving a defectless coating layer.

The present invention provides a process for producing an electrophotographic photosensitive member through application of a paint by dipping an object to be coated into a paint coating bath, the process comprising steps of: blowing a gas periodically into the paint from a lower portion of the paint coating bath to agitate the paint, and dipping the object to be coated at a predetermined time after agitating the paint.

DETAILED DESCRIPTION OF THE PREFERRED EMBODIMENT

Figure 1:
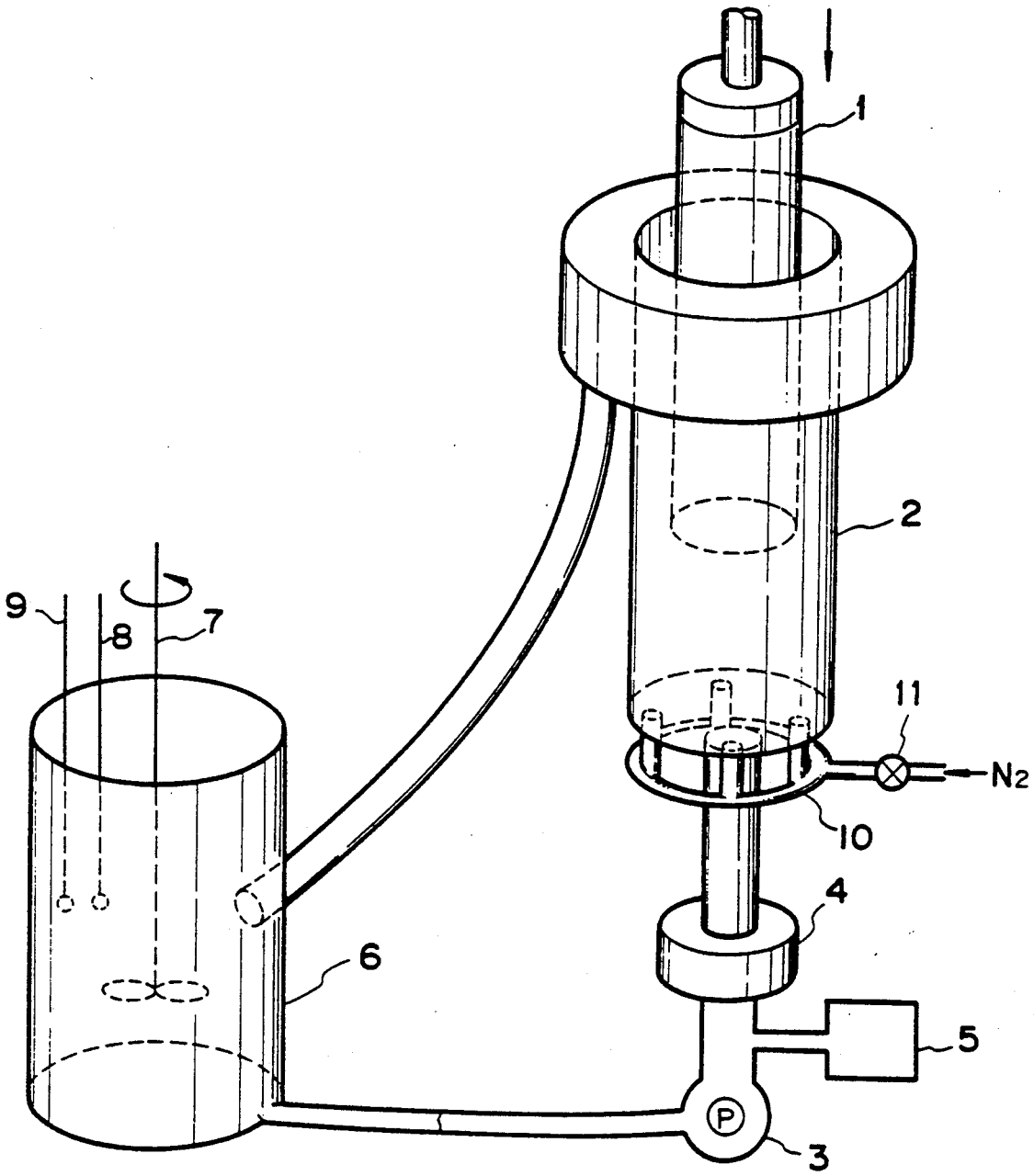
FIG. 1 is a schematic diagram of an apparatus for practicing the process of production of the present invention.

The present invention is described in detail referring to an example of the apparatus shown in FIG. 1.

In FIG. 1, the numeral 1 denotes a cylindrical coating object for constituting an electrophotographic photosensitive member. The coating object may be made of any material which is useful generally for an electrophotographic photosensitive member, an example being aluminum. The portion to be coated of the coating object 1 is immersed in the paint of a paint coating bath 2 for a required time, and then lifted at a required speed to be taken out. The paint is fed to the paint coating bath 2 from an agitation vessel 6 through a pump 3, air damper 5, and a filter 4. The paint is recycled from the upper portion of the paint coating bath 2 to the agitation vessel 6. The agitation vessel 6 is equipped with an agitator 7, a temperature sensor 8 for temperature control, and a viscosity sensor for viscosity control.

Further in the present invention, the paint coating vessel 2 is provided at the bottom thereof with a gas blow-in nozzle 10, so that gas, like nitrogen, may be fed through an electromagnetic valve 11. The magnetic valve 11 opens the feed line during the time in which the coating object 1 is not dipped in the paint coating bath 2 to blow a dry gas into the paint coating bath 2 and to agitate the paint by gas bubbles rising in the bath. The timing for stopping the gas introduction, namely for shutting the electromagnetic valve 11, is set with an additional increment of time so that the all bubbles caused by the blown gas have disappeared at the time when the coating object 1 enters the paint coating bath 2. Consequently, the state of the coating on the surface of the coating object 1 is not adversely affected by the bubbles blown therein.

Such an operational sequence in the process is desirably repeated automatically by action of a coating object position sensor, a sequence controller, the aforementioned electromagnetic valve 11 and the like. Incidentally, the pump 3, the filter 4, the air damper 5, the temperature sensor 8, the viscosity sensor 9, and the agitator 7 function ordinarily at their respective positions.

An example of the operational conditions of the dip coating is shown below.

Size of paint coating bath: 136 mm diameter $\times$ 500 mm

Flow rate of paint: 2.0 l/min

Gas blow-in rate: 2.0 l/min for 30 sec.

Coating speed: 600 mm/min.

The gas to be blown into the paint in the present invention may be of any kind, if it does not adversely affect the paint. The Examples are air, nitrogen, argon, and the like.

The paint used in the present invention is not limited at all. The present invention is particularly effective for dispersion types of paints in which a pigment is dispersed in a resin, used in electrophotographic application field, especially for those having average pigment particle diameter of 0.1 μ or less.

The examples of the pigments include azo pigments, quinone pigments, quinocyanine pigments, perylene pigments, indigo pigments, azulenium pigments, phthalocyanine pigments, and the like.

The useful resin includes polyvinyl butyrals, polystyrenes, polyvinyl acetates, acrylic resins, polyvinylpyrrolidones, ethylcelluloses, cellulose acetate lactates, polyesters, polycarbonates, polyethyl methacrylates, polyamides, polyurethanes, polyureas, phenol resins, and the like.

The present invention is described more specifically referring to Examples.

EXAMPLE 1 and COMPARATIVE EXAMPLE 1

By use of the above described apparatus, coating was conducted to laminate the four layers comprising an electroconductive layer, a subbing layer, a charge-generating layer, and a charge-transporting layer sequentially in this order on an electroconductive support to produce a laminate type electrophotographic photosensitive member. The nitrogen blow was conducted only at the step of formation of a charge-generating layer. In Comparative Example 1, the nitrogen blow was not conducted even at the step of formation of a charge generating layer. The coating object for the photosensitive member was an aluminum cylinder of 80 mm in diameter and 360 mm in length. The compositions of the paints for the respective layer are shown in Table 1.

In Example 1, as shown in Table 2, no irregularity of the coated surface of the charge generating layer was observed and little rise of the viscosity of the paint was found even when a number of coating objects are continuously treated for coating. On the contrary in Comparative Example 1, a band-like irregularity of the coated surface was observed and the viscosity increased greatly.

The electrophotographic photosensitive member of the present invention thus prepared was used for image formation with a copying machine which works through a process comprising pre-exposure, negative primary charging, image exposure, one-component toner developement, image transfer, and cleaning. The resulting image was found to be excellent in uniformity even in half-tone images.

EXAMPLE 2 and COMPARATIVE EXAMPLE 2

Laminate type electrophotographic photosensitive members were prepared in the same manner as in Example 1 except that materials shown in Table 3 were used. In Example 2, the blow of nitrogen was conducted at the coating steps of subbing layers and charge-generating layers. In Comparative Example 2, the blow of nitrogen was not conducted.

In the present invention as shown in Table 4, any defect such as irregularity, lumps, or streaks was not observed on the coated surface of the charge-generating layer and the subbing layer, and little rise of the viscosity of the paint was found.

The electrophotographic photosensitive member of the present invention thus prepared was used for image formation with a copying machine which works through a process comprising pre-exposure, negative primary charging, image exposure with a semiconductor laser ($\lambda=780$ μm), one-component toner development, image transfer, and cleaning. The resulting image was evaluated to be less defective, and less liable to form dots and fogging in view of durability.

EXAMPLE 3 and COMPARATIVE EXAMPLE 3

Laminate type electrophotographic photosensitive members were prepared and evaluated in the same manner as in Example 1 and Comparative Example 1, respectively, except that materials shown in Table 3 were used.

In Example 3, as shown in Table 6, any irregularity, lump, or streak was not observed on the coated surface of the charge-generating layer, and the rise of the viscosity of the paint was found to be slight. The resulting image was found to be excellent in uniformity even in half-tone images.

TABLE 1

| Layer | Material | |
|---|---|---|
| Electroconductive layer (Layer thickness: 20μ) | Electroconductive titanium oxide | 40 parts (Particle diameter: 0.5–1.0μ) |
| | Phenol resin | 20 parts |
| | Methylcellosolve | 20 parts |
| | Methanol | 20 parts |
| Subbing layer (Layer thickness: 1μ) | Polyamide | 10 parts |
| | Methanol | 60 parts |
| | n-butanol | 30 parts |
| Charge-generating layer (Layer thickness: 0.2μ) | Disazo pigment of following formula: | 1 part (Particle diameter: 0.05μ) |
| | 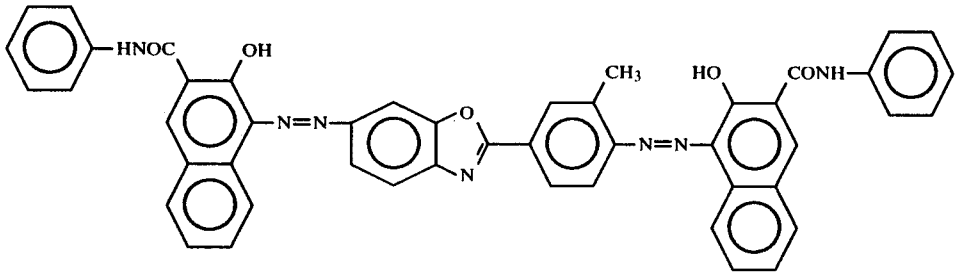 | |
| | Butyral resin | 1 part |
| | Methyl ethyl ketone | 98 parts |
| Charge-transporting layer (Layer thickness: 20μ) | Hydrazone compound of following formula: | 10 parts |
| | 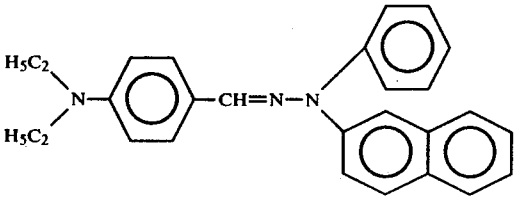 | |
| | Styrene-acrylic resin | 10 parts |
| | Monochlorobenzene | 80 parts |

TABLE 2

| | Coated surface | | Paint viscosity | |
|---|---|---|---|---|
| | At initial stage | After continuous coating for one hour | At initial stage | After continuous coating for one hour |
| Example 1 | Good | Good | 3.2 cps | 3.5 cps |
| Comparative example 1 | Good | Band-like irregularity in concentration | 3.2 cps | 9.7 cps |

TABLE 4

| | | Example 2 | Comparative example 2 |
|---|---|---|---|
| Coated surface of charge-generating layer | At initial stage | Good | Good |
| | After continuous coating for one hour | Good | Slightly irregular |
| Viscosity of pigment for charge-generating layer | At initial stage | 2.5 cps | 2.5 cps |
| | After continuous coating for one hour | 2.5 cps | 3.2 cps |
| Coated surface of subbing layer | At initial stage | Good | Good |
| | After continuous coating for one hour | Good | Streak-like lumps occurring |
| Viscosity of pigment for subbing layer | At initial stage | 8.5 cps | 8.5 cps |
| | After continuous coating for one hour | 10.1 cps | 32.3 cps |

TABLE 3

| Layer | Material | |
|---|---|---|
| Electroconductive layer (Layer thickness: 20μ) | Electroconductive titanium oxide | 40 parts (Particle diameter: 0.5–1.0μ) |
| | Phenol resin | 20 parts |
| | Methylcellosolve | 20 parts |
| | Methanol | 20 parts |
| Subbing layer (Layer thickness: 2μ) | Zinc oxide | 10 parts (Particle diameter: 0.08μ) |
| | Thermosetting urethane resin | 5 parts |
| | Methyl ethyl ketone | 85 parts |
| Charge-generating layer (Layer thickness: 0.2μ) | Phthalocyanine pigment of following formula: | 1 part (Particle diameter: 0.15μ) |

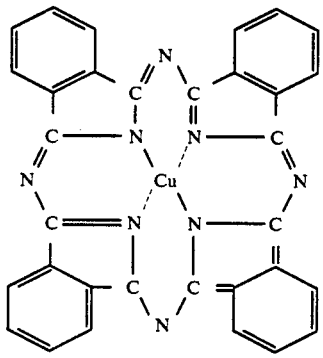

| | | |
|---|---|---|
| | Butyral resin | 1 part |
| | Methyl ethyl ketone | 98 parts |
| Charge-transporting layer (Layer thickness: 20μ) | Hydrazone compound of following formula: | 10 parts |

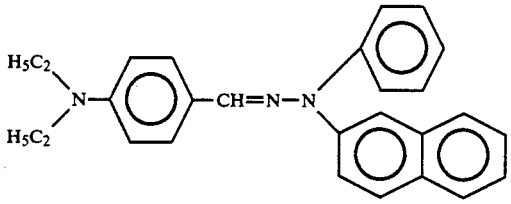

| | | |
|---|---|---|
| | Styrene-acrylic resin | 10 parts |
| | Monochlorobenzene | 80 parts |

TABLE 5

| Layer | Material | |
|---|---|---|
| Electroconductive layer (Layer thickness: 20μ) | Electroconductive titanium oxide | 40 parts (Particle diameter: 0.5–1.0μ) |
| | Phenol resin | 20 parts |
| | Methylcellosolve | 20 parts |
| | Methanol | 20 parts |
| Subbing layer (Layer thickness: 1μ) | Polyamide | 10 parts |
| | Methanol | 60 parts |
| | n-butanol | 30 parts |
| Charge-generating layer (Layer thickness: 0.2μ) | Disazo pigment of following formula: | 1 part (Particle diameter: 0.02μ) |

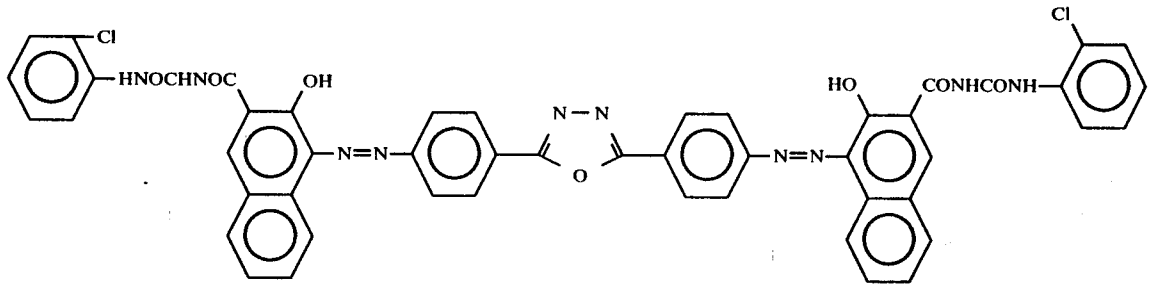

| | | |
|---|---|---|
| | Butyral resin | 1 part |
| | Methyl ethyl ketone | 98 parts |
| Charge-transporting layer (Layer thickness: 20μ) | Styryl compound of following formula: | 10 parts |

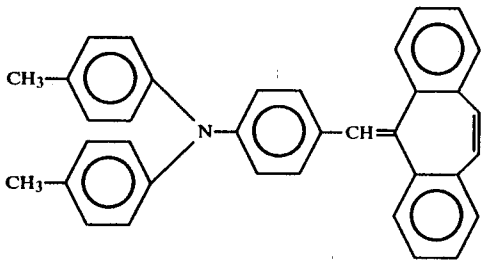

| | | |
|---|---|---|
| | Styrene-acrylic resin | 10 parts |
| | Monochlorobenzene | 80 parts |

TABLE 6

| | Coated surface | | Paint viscosity | |
|---|---|---|---|---|
| | At initial stage | After continuous coating for one hour | At initial stage | After continuous coating for one hour |
| Example 3 | Good | Good | 4.5 cps | 5.8 cps |
| Comparative example 3 | Good | Streak-like irregularity occurring | 4.5 cps | 11.3 cps |

What is claimed is:

1. A process for producing an electrophotographic photosensitive member through application of a paint by dipping an electrophotographic photosensitive cylinder into a paint coating bath for forming an intermediate layer or a photosensitive layer which comprises the steps of: blowing a gas periodically into a paint comprising a pigment having an average particle diameter of not more than 0.1 micron and a resin from a lower portion of the paint coating bath to agitate the paint and to maintain a substantially uniform paint viscosity during processing and dipping the electrophotographic photosensitive cylinder at a predetermined time after agitating the paint to form the intermediate or photosensitive layer less than 10 microns thick which layer is free of observable surface irregularities which adversely effect images developed by said electrophotographic photosensitive member.

2. The process of claim 1, wherein the pigment is an organic pigment.

* * * * *